US005345611A

United States Patent [19]

Smith, Jr.

[11] Patent Number: 5,345,611

[45] Date of Patent: Sep. 13, 1994

[54] SNOWBALL GLOVES

[76] Inventor: Robert D. Smith, Jr., 5630 W. 64th St., Chicago, Ill. 60638-5520

[21] Appl. No.: 138,733

[22] Filed: Oct. 20, 1993

[51] Int. Cl.[5] ..... A41D 19/00

[52] U.S. Cl. ..... 2/160

[58] Field of Search ..... 273/29 A; 2/160, 19, 2/168, 161.1, 161.2, 161.3, 159, 158, 16, 20, 910, 917; 294/25, 51, 54, 55, 59; 249/78; 441/56, 57

[56] References Cited

U.S. PATENT DOCUMENTS

| | | | |
|---|---|---|---|
| 3,638,011 | 1/1972 | Bain et al. | 2/160 X |
| 3,877,742 | 4/1975 | Hatfield | 294/55 |
| 4,034,981 | 7/1977 | Veneziano | 273/29 A |
| 4,378,670 | 4/1983 | Check et al. | 294/55 X |
| 4,988,296 | 1/1991 | Spencer | 2/168 X |
| 5,000,317 | 3/1991 | Cich | 2/19 X |

FOREIGN PATENT DOCUMENTS

| | | | |
|---|---|---|---|
| 2640866 | 6/1990 | France | 294/55 |

*Primary Examiner*—Clifford D. Crowder
*Assistant Examiner*—Sara M. Current
*Attorney, Agent, or Firm*—E. Michael Combs

[57] ABSTRACT

Glove members are arranged in a mirror image relationship relative to one another, including facing first and second palm walls having removably mounted thereon, first and second semi-spherical cup members. The cup members are arranged for complementary inter-fitting relative to one another to define a spherical shape to form snowballs therebetween when snow is scooped into the semi-spherical cup members.

3 Claims, 4 Drawing Sheets

SNOWBALL GLOVES

BACKGROUND OF THE INVENTION

1. Field of the Invention

The field of invention relates to snowball making devices, and more particularly pertains to new and improved snowball gloves arranged for forming snowballs therebetween.

2. Description of the Prior Art

Snowball forming structure is indicated in the prior art and exemplified by U.S. Pat. No. 5,000,153 having a cup member mounted to the end of a stick to form snowballs. U.S. Pat. Nos. 4,859,167 and 5,080,572 indicate plier type cup members arranged for forming snowballs therebetween in a molding structure.

The instant invention attempts to overcome deficiencies of the prior art by providing for glove members arranged for selectively mounting confronting cup members to mold snowballs therebetween and in this respect, the present invention substantially fulfills this need.

SUMMARY OF THE INVENTION

In view of the foregoing disadvantages inherent in the known types of snowball making apparatus now present in the prior art, the present invention provides snowball gloves wherein the same are arranged for the mounting of facing cup members to form snowballs in a molding procedure. As such, the general purpose of the present invention, which will be described subsequently in greater detail, is to provide new and improved snowball gloves which has all the advantages of the prior art snowball making apparatus and none of the disadvantages.

To attain this, the present invention provides glove members arranged in a mirror image relationship relative to one another, including facing first and second palm walls having removably mounted thereon first and second semi-spherical cup members. The cup members are arranged for complementary inter-fitting relative to one another to define a spherical shape to form snowballs therebetween when snow is scooped into the semi-spherical cup members.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved snowball gloves which has all the advantages of the prior art snowball making apparatus and none of the disadvantages.

It is another object of the present invention to provide new and improved snowball gloves which may be easily and efficiently manufactured and marketed.

It is a further object of the present invention to provide new and improved snowball gloves which is of a durable and reliable construction.

An even further object of the present invention is to provide new and improved snowball gloves which is susceptible of a low cost of manufacture with regard to both materials and labor, and which accordingly is then susceptible of low prices of sale to the consuming public, thereby making such snowball gloves economically available to the buying public.

Still yet another object of the present invention is to provide new and improved snowball gloves which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
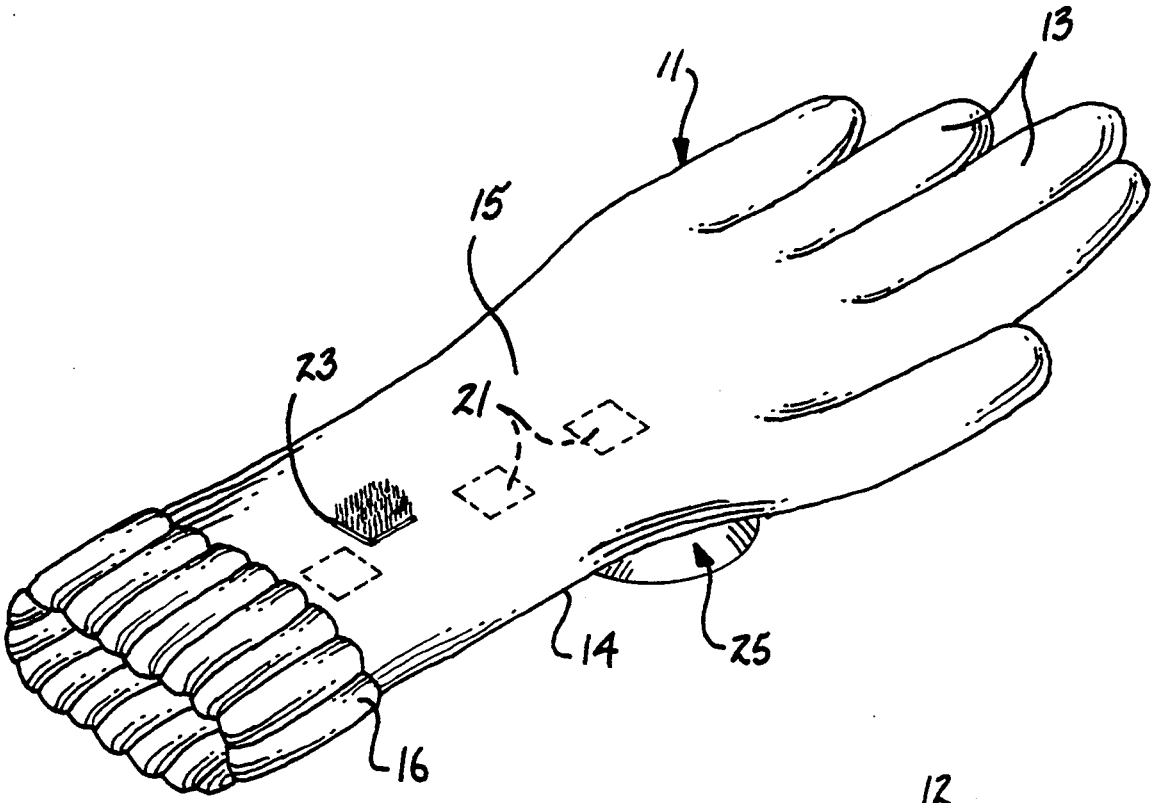
FIG. 1 and FIG. 2 are isometric illustrations of the respective first and second gloves of the invention.

With reference now to the drawings, and in particular to FIGS. 1 to 7 thereof, new and improved snowball gloves embodying the principles and concepts of the present invention and generally designated by the reference numerals 11–43 will be described.

Figure 2:
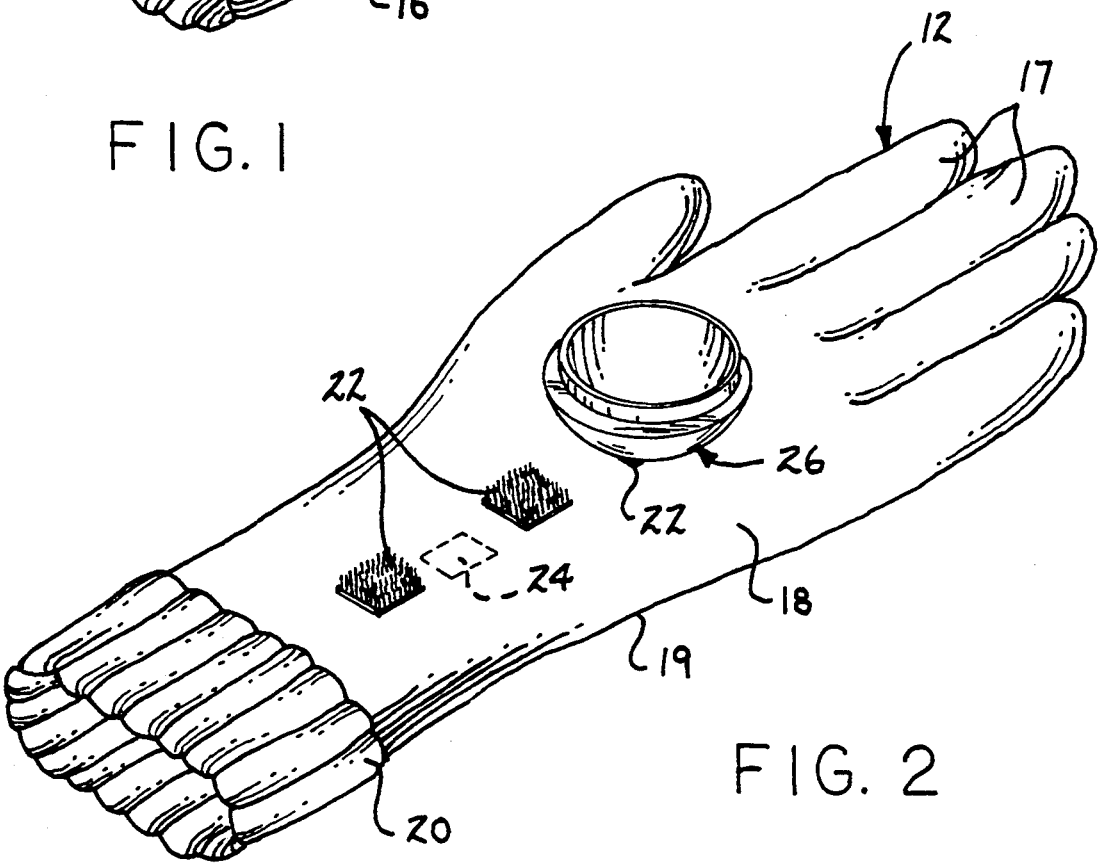
Figure 3:
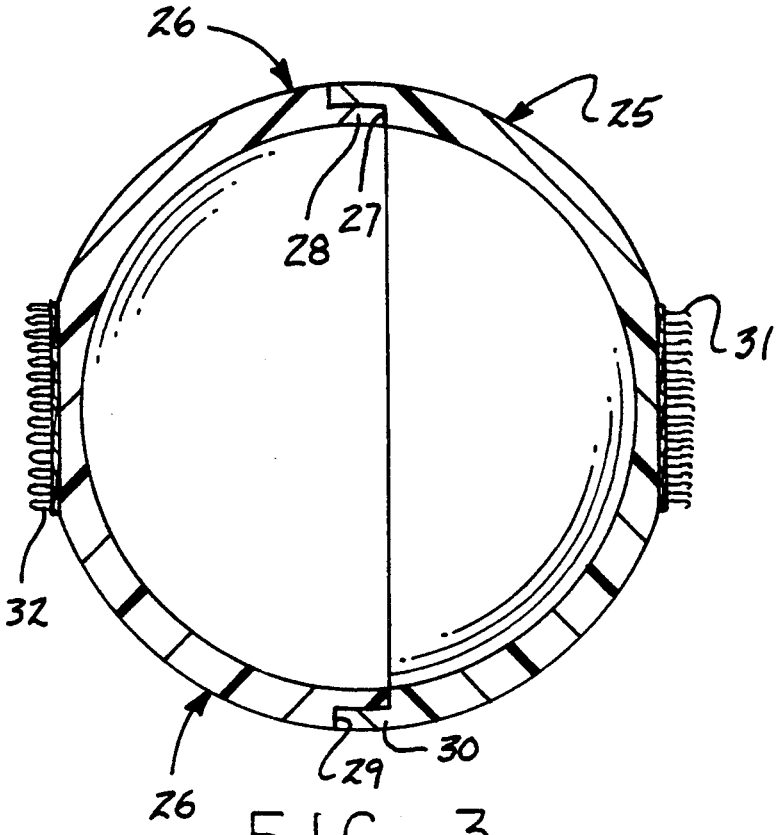
FIG. 3 is an orthographic cross-sectional illustration of the first and second semi-spherical cup members illustrated in an inter-fitting relationship.
Figure 4:
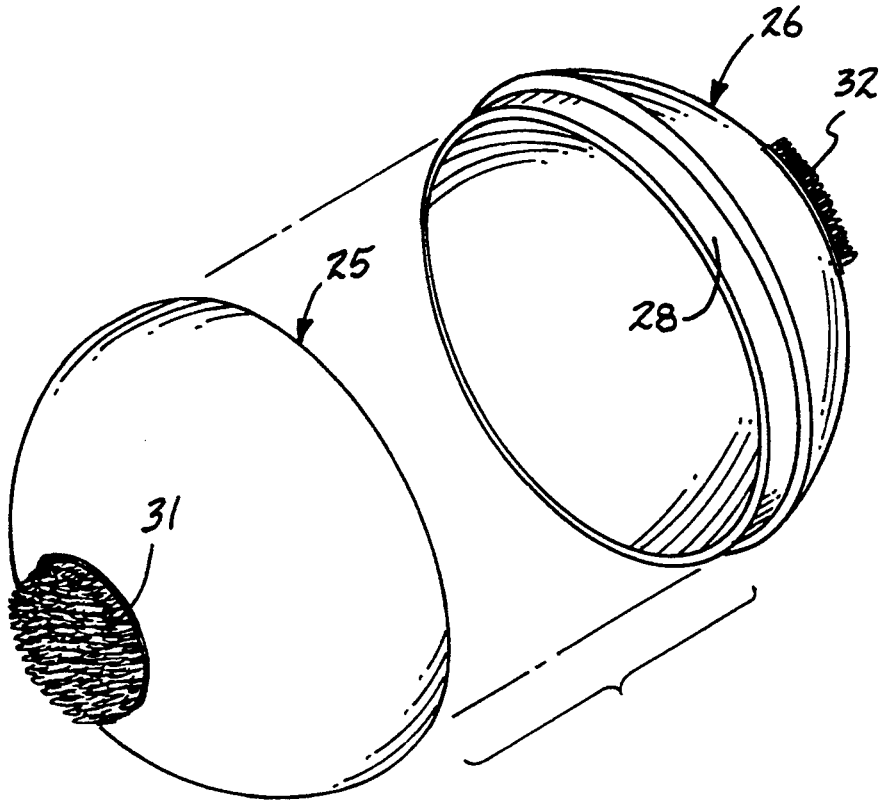
FIG. 4 is an isometric illustration of the first and second semi-spherical cup members.

More specifically, the snowball gloves of the instant invention essentially comprise a first glove 11 of a right-hand construction in cooperation with a second glove member 12 of a left-hand construction, as indicated in the FIGS. 1 and 2 respectively. The first glove member 11 is formed with first glove member finger sockets 13, a first glove palm wall 14, and a first glove rear wall 16, as well as a first glove wrist portion 16 that may be formed of elastomeric material if desired. The second glove member 12 is formed with a second glove plurality of finger sockets 17, a second glove palm wall 18 spaced from a second glove rear wall 19, and a second glove wrist portion 20 that also may be formed of an elastomeric material. First glove first hook and loop fastener patches 21 and second glove first hook and loop fastener patches 22 are positioned in a row along the respective first and second glove palm walls 14 and 18 respectively. First and second glove second hook and loop fastener patches 23 and 24 respectively are mounted to the first and second glove rear walls 15 and 19 respectively. The second hook and loop fastener patches 23 and 24 are arranged for securing the first and second glove members 11 and 12 together in a rear wall to rear wall facing relationship. The first hook and loop fastener patches 21 and 22 respectively of the first glove members are arranged for the selective positioning of respective first and second semi-spherical cup members 25 and 26 to fall into the first and second hook and loop fastener patches 21 and 22 in a desired orientation to the palm walls for the comfort and convenience of a user thereof providing for the adjustable positioning of the cup members. The cup members are arranged for use in a complementary inter-fitting relationship, such as indicated in the FIGS. 3 and 4, to receive snow therebetween and thereafter permit the compaction and molding of the snow into a snowball. The removal aspect of the cup members further permits the ease of throwing the snowballs subsequent to their forming. The cup members may be removed, or alternatively positioned closer to the wrist portions of the first and second glove members to further ease the throwing of the snowballs subsequent to their formation. The first cup member 25 is formed with a first cup annular wall 27 arranged to receive a second cup member flange 28, with a first cup annular flange 29 arranged for complementary reception within the second cup member in abutment to a second cup annular wall 30. The first and second cup walls 27 and 30 are arranged in a parallel relationship relative to one another and offset relative to one another, as illustrated, such that the inter-fitting of the flanges and wall structure of the first and second cup members provide for the proper alignment of the first and second cup members together to form a spherical snowball (not shown). The first and second cup members 25 and 26 are also formed to include first and second cup hook and loop fastener patches 31 and 32 arranged for positioning upon the respective first and second glove first and second hook and loop fastener patches 21 and 22 respectively.

Figure 5:
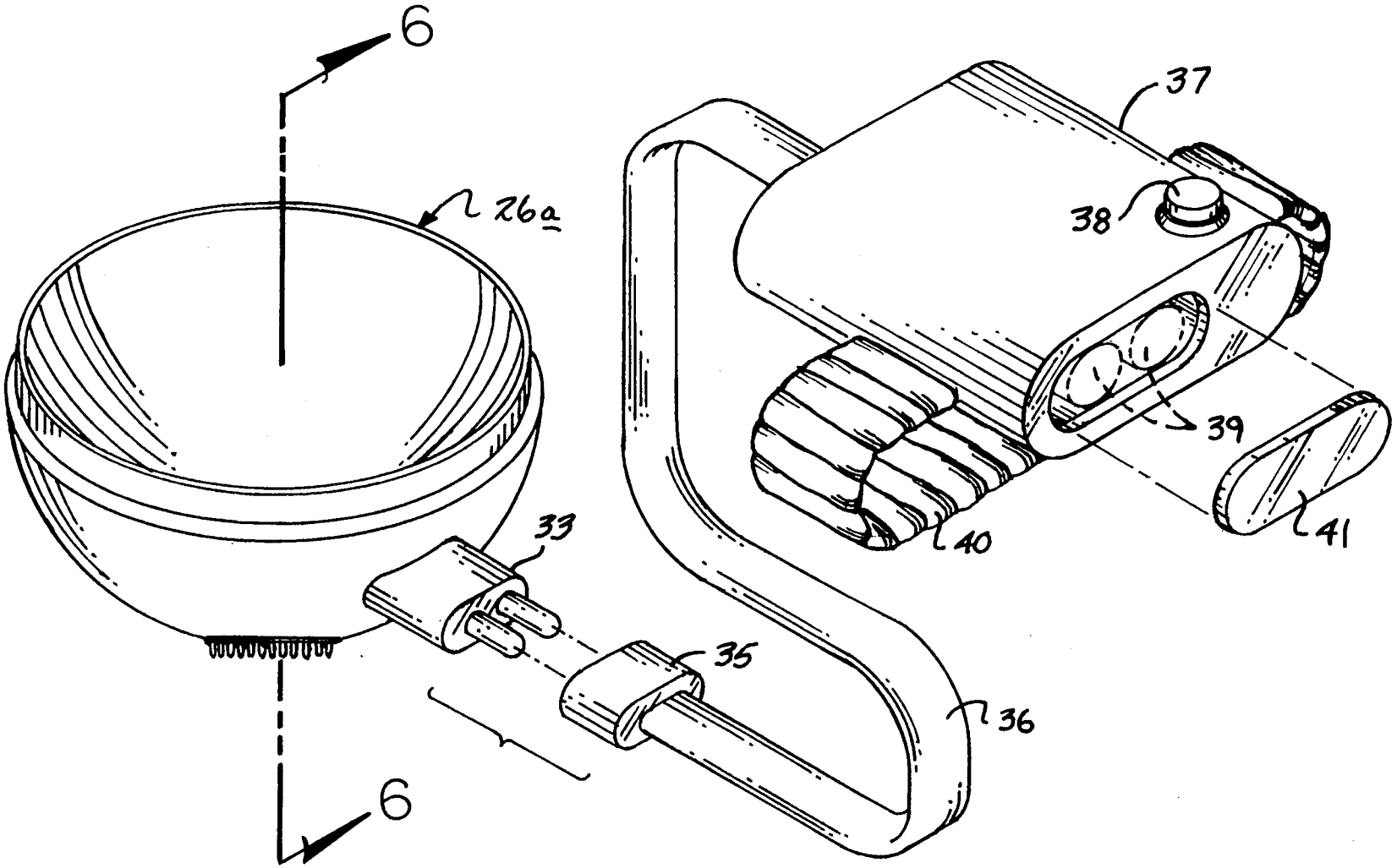
FIG. 5 is an isometric illustration of a modified second cup member.
Figure 6:
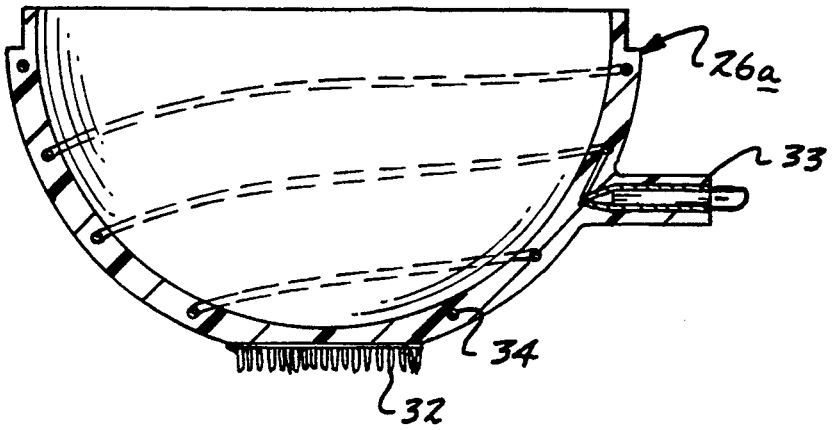
FIG. 6 is an orthographic view, taken along the lines 6—6 of FIG. 5 in the direction indicated by the arrows.

The FIG. 5 and the FIG. 6 indicate the use of a modified second cup member **26*a*, having an electrical connector 33 in electrical communication with a heating coil 34 of an electrical resistance type (see FIG. 6) directed throughout the second cup member 26*a*. An electrical socket 35 arranged to receive the electrical connector 33 is configured to form electrical communication with batteries 39 within a battery housing 37 communicating through an electrical supply cable 36 between the electrical socket 35 and the batteries 39. The switch 38 is positioned for ease of operation and access and positioned upon a top wall of the battery housings, and a bottom wall of the battery housing including an elastomeric band 40 for securement about an individual's wrist (see FIG. 7) spaced from the second glove member. A door plate 41 mounted to the battery housing's front wall provides for access to the batteries 39** for their replacement as required.

Figure 7:
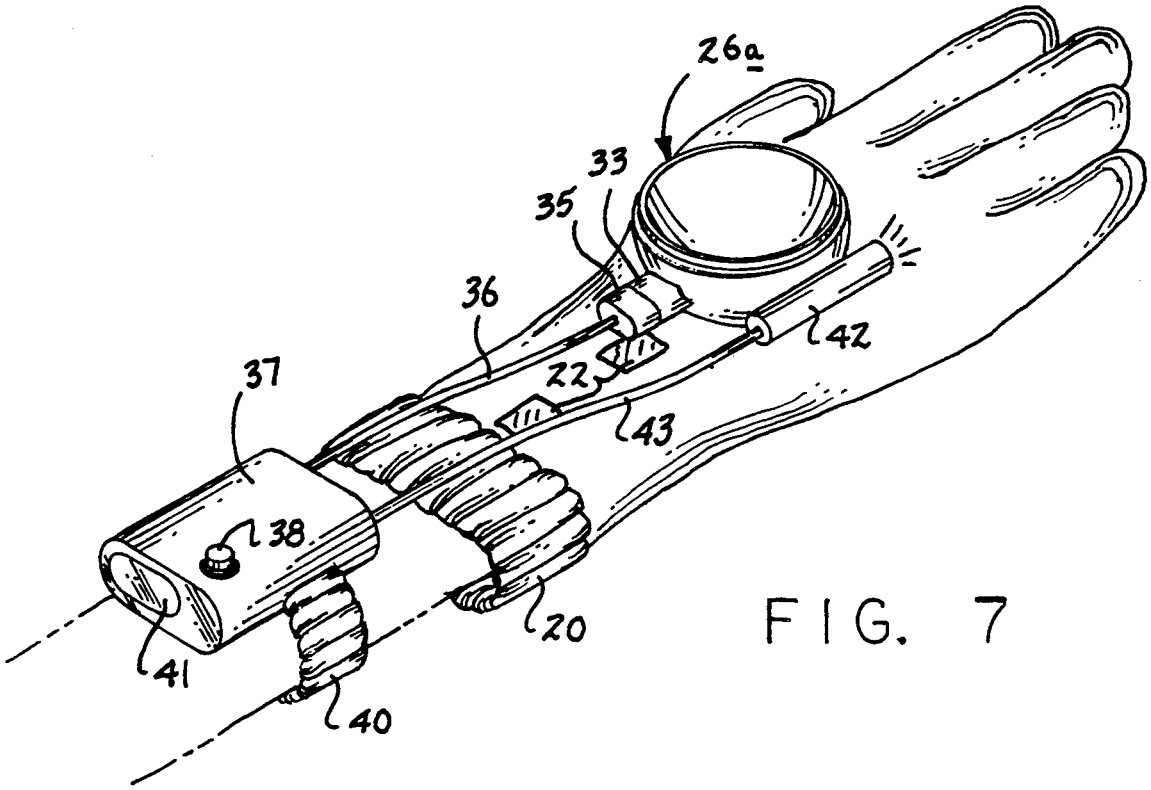
FIG. 7 is an isometric illustration of the modified cup member mounted to the second glove in further use of a flashlight member to indicate orientation of the second cup member.

Further in FIG. 7 an optional flashlight member 42 secured to the modified second cup member **26*a* is in electrical communication with the batteries through a flashlight electrical cable 43**. In this manner, during periods of limited available light, the flashlight member is illuminated to provide and indicate orientation and positioning of the second cup member. It may be understood that the same construction may be applied to the first cup member in a like manner. The heating of the cup members provides for limited melting of the snow to provide for enhanced compaction and formation of the snow within the cup members, as well as the ease of removal of the completed snowball construction.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Snowball gloves, comprising, a first glove member and a second glove member, the first glove member including a first glove palm wall, the second glove member having a second glove palm wall, with the first glove further including a first glove rear wall spaced from the first glove palm wall, and the second glove member having a second glove rear wall spaced from the second glove palm wall, and a row of first glove first hook and loop fastener patches extending along the first glove palm wall, the second glove palm wall having a further row of second glove first hook and loop fastener patches, and a first semi-spherical cup member having a first cup hook and loop fastener patch arranged for selective securement to one of the first glove first hook and loop fastener patches, and a second semi-spherical cup member having a second cup hook and loop fastener patch arranged for securement to one of the second glove first hook and loop fastener patches, and the first semi-spherical cup member includes a first cup annular wall, the second semi-spherical cup member having a second cup annular flange arranged for abutment with the first cup annular wall, and the first semi-spherical cup member further including a first cup annular flange, and the second semi-spherical cup member including a second cup annular wall, with the second cup annular wall arranged for abutment with the first cup annular flange when the first semi-spherical cup member is arranged in inter-fitting complementary relationship with the second semi-spherical cup member.

2. Snowball gloves as set forth in claim 1 wherein the at least second semi-spherical cup member includes an electrical connector and an electrical resistance heating coil directed through the second semi-spherical cup member in electrical communication with the electrical connector, and an electrical supply cable having a supply cable first end, including an electrical socket arranged for electrical communication with the electrical connector, and the supply cable having a second end and a battery housing mounted to the second end, with the battery housing including at least one battery member therewithin, and a battery housing top wall having a switch member therethrough to effect selective electrical communication between the at least one battery and the heating coil, and the battery housing having a battery housing bottom wall including an elastomeric band permitting securement of the elastomeric band about an individual's wrist portion.

3. Snowball gloves as set forth in claim 2 including a flashlight member mounted to the second semi-spherical cup member and the flashlight electrical cable effecting selective electrical communication between the flashlight member and the at least one battery through the switch.

* * * * *